US005607379A

United States Patent [19]

Scott

[11] Patent Number: 5,607,379

[45] Date of Patent: Mar. 4, 1997

[54] WEIGHT RING EXERCISE SYSTEM

[76] Inventor: Michael L. Scott, 100 Caroline St., Rockingham, N.C. 28379

[21] Appl. No.: 506,074

[22] Filed: Jul. 24, 1995

[51] Int. Cl.[6] ..... A63B 21/075

[52] U.S. Cl. ..... 482/107

[58] Field of Search ..... 482/106–109, 482/53

[56] References Cited

U.S. PATENT DOCUMENTS 4,076,236 2/1978 Ionel .

FOREIGN PATENT DOCUMENTS 338610 5/1904 France ..... 482/108

1687271 10/1991 U.S.S.R. ..... 482/107

*Primary Examiner*—Richard J. Apley
*Assistant Examiner*—John Mulcahy

[57] ABSTRACT

The weight ring exercise system includes a weight collar rotatably attached to a weightlifting bar. A plurality of progressively larger weight rings are provided. The smaller weight rings are circumscribed in turn by the larger. The smallest weight ring circumscribes the collar. The weight rings are secured to each other and the collar in turn by a bearing seated in a groove on the smaller weight rings and the collar. A plunger is provided to seat and unseat the bearing in the groove.

14 Claims, 4 Drawing Sheets

WEIGHT RING EXERCISE SYSTEM

BACKGROUND OF THE INVENTION

1. Field of the Invention

The invention generally relates to a system by which weights can be attached to both ends of a free bar for the purpose of being used as an exercise device in concert with an exercise bench.

2. Description of the Prior Art

Free Bar Bench Press systems currently in use utilize a system by which circular disks with holes in the center are slid onto a long bar which is held by a bench configuration in a horizontal position. To increase or decrease weight on the bar the user must first remove a collar which holds the disks on the bar by loosening the collar and sliding it off the end of the bar. The user then removes or installs the desired number of disks by sliding them off or on the bar. The user then re-installs the collar and locks it into place. This process requires a good deal of room space and time to accomplish. The many weights that are required to create sufficient weight variation on the bar for a good workout are cumbersome, also, a great deal of room space is required to maneuver around the bar to change the weights. The long weight bar and numerous weights are hard to store in the home.

This invention will reduce the length of the bar, greatly improve the system by which weight is increased and decreased on the bar and by virtue of the design, the ability to store this equipment is enhanced.

This system will maintain the style of the Free Weight Bench system, but will greatly reduce the room needed to utililize and store this type of equipment.

SUMMARY OF THE INVENTION

The invention relates to a system by which free weight rings can be attached or taken off a weight collar attached to a bar using less time, effort, and room space than the type of system currently in use today. The weight rings of my design would mount one circumjacent to the other as a vertically expanding disk, the whole disk being comprised of subsections or rings. The ring system would mount via a special collar screwed onto the end of a threaded bar. The weight bar and rings would be used in concert with a specially designed bench press to allow storage of all pieces of equipment within the confines of the bench.

It is the object of this invention to provide a Bench Press Free Weight system that is simple to use and stores as a unit. This system, which is mainly designed for the person who wants to work out at home, has numerous advantages over the conventional bench press barbell unit.

DESCRIPTION OF THE PREFERRED EMBODIMENT

Figure 1:
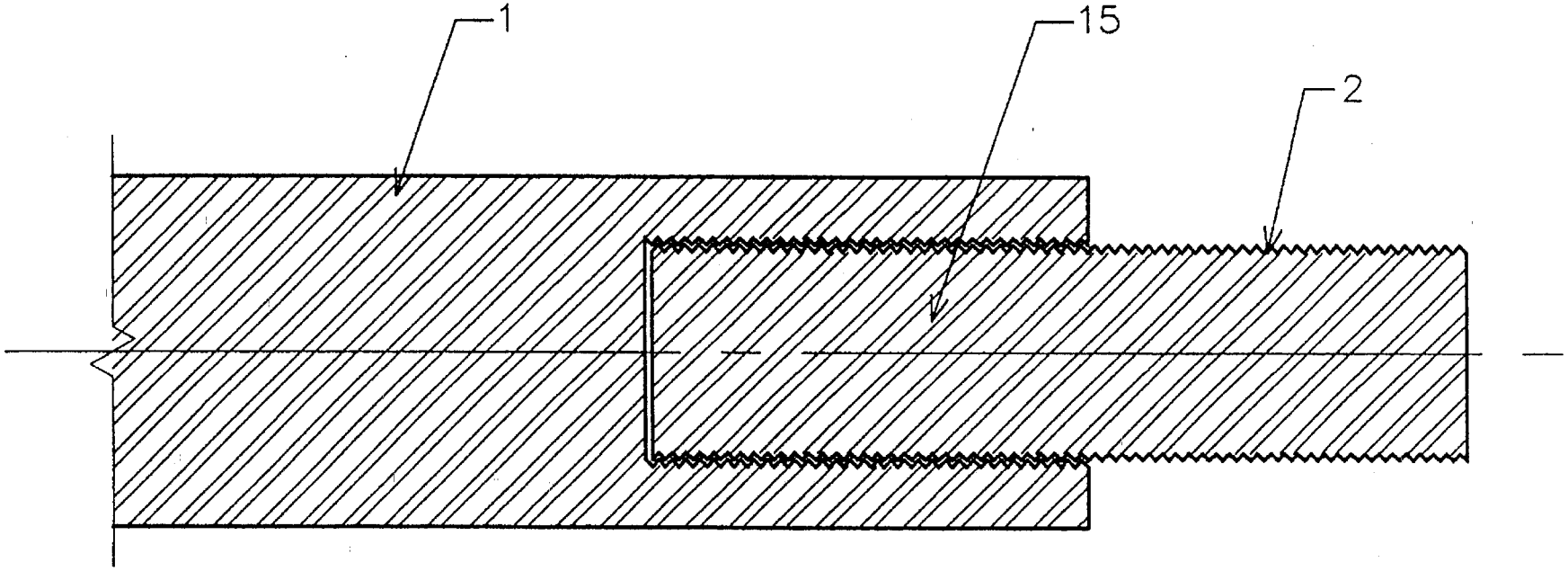
FIG. 1 shows one end of the weight bar. In this view the smaller section of the bar (dumbell) is screwed into the end of the bar. The threaded end exposed is for the collar to screw onto.
Figure 2:
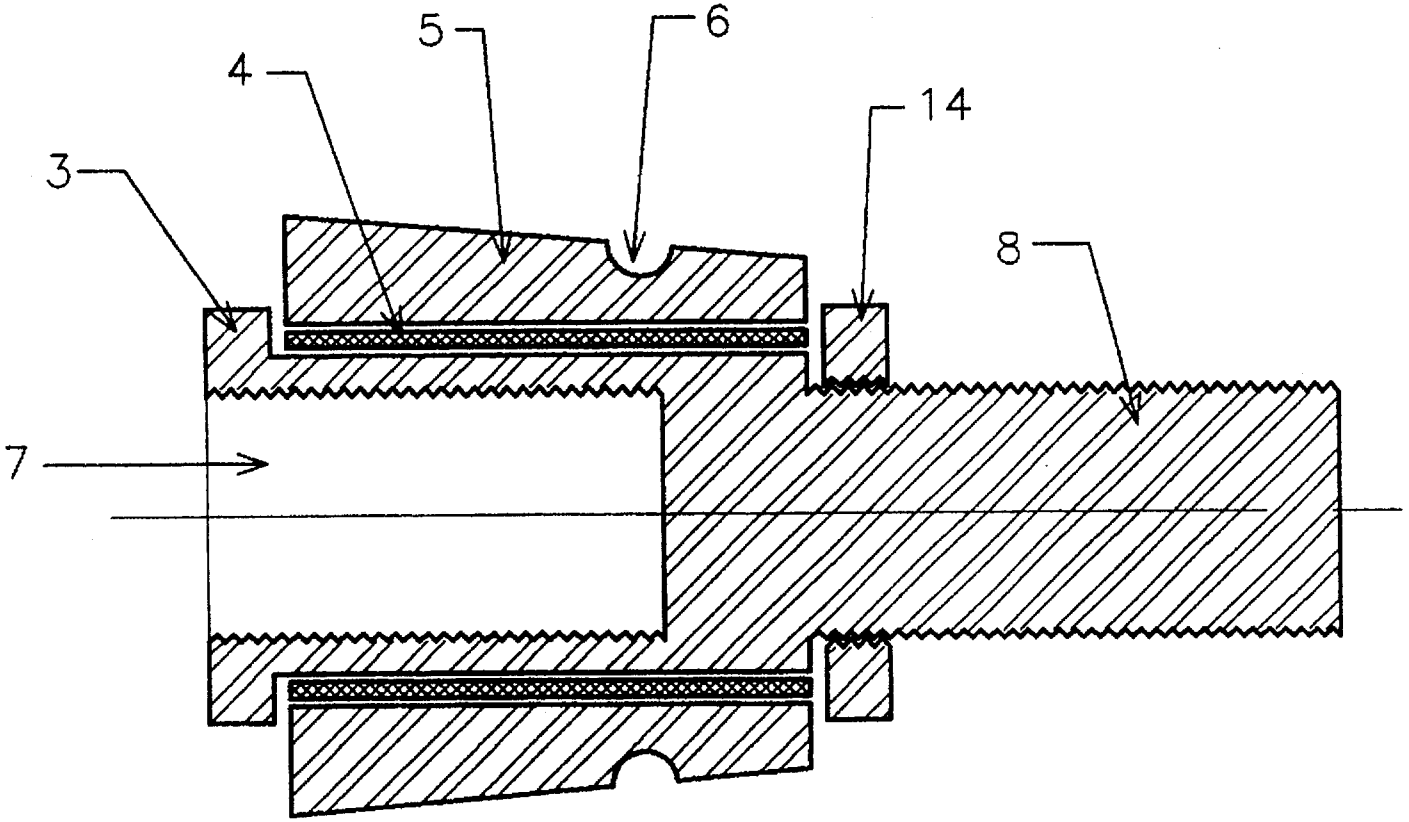
FIG. 2. The collar is shown in a cross sectional view as it relates to the position in which it screws onto the bar.
Figure 3:
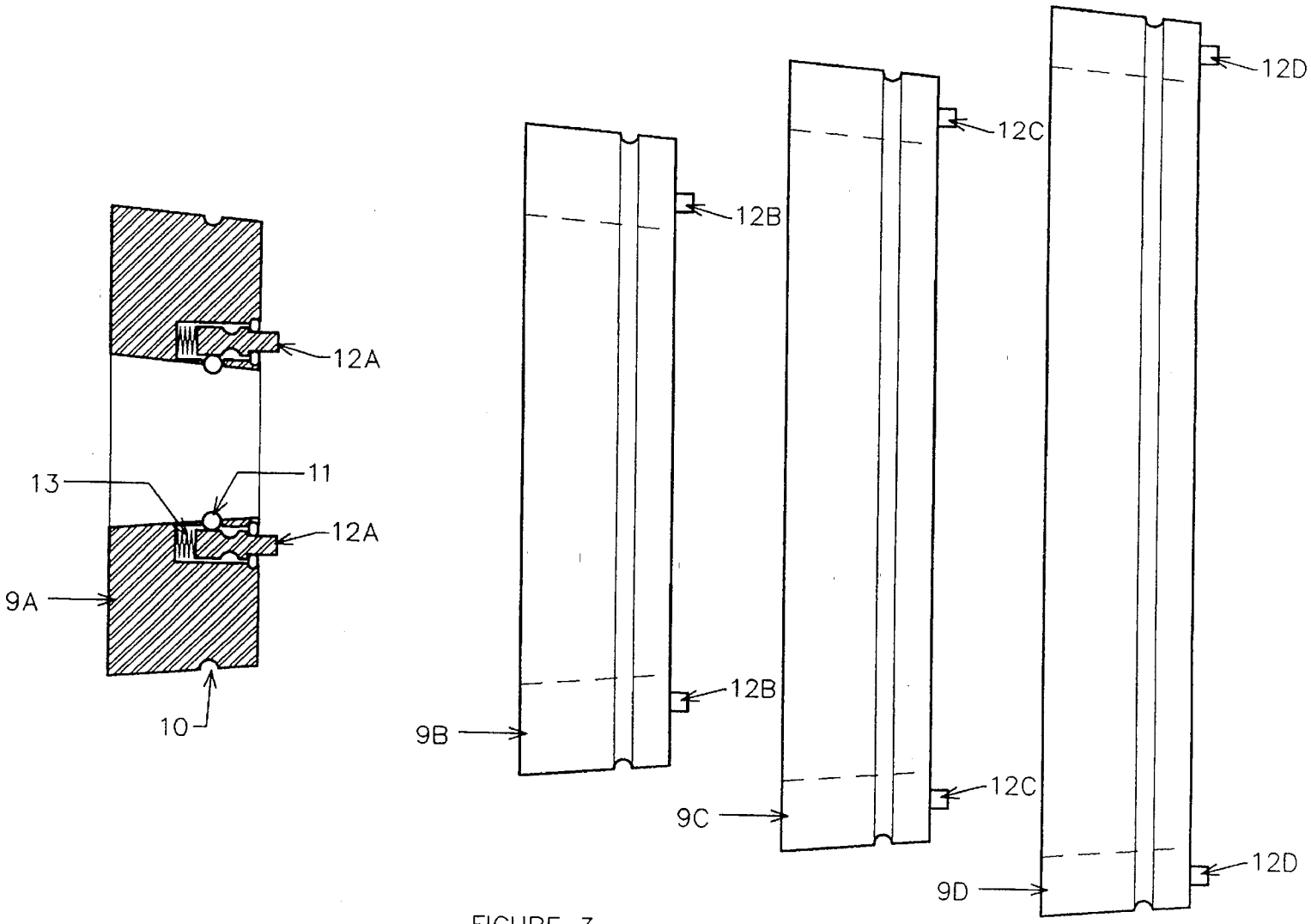
FIG. 3 shows the positioning of the weight rings in their relationship to the collar and the bar.
Figure 4B:
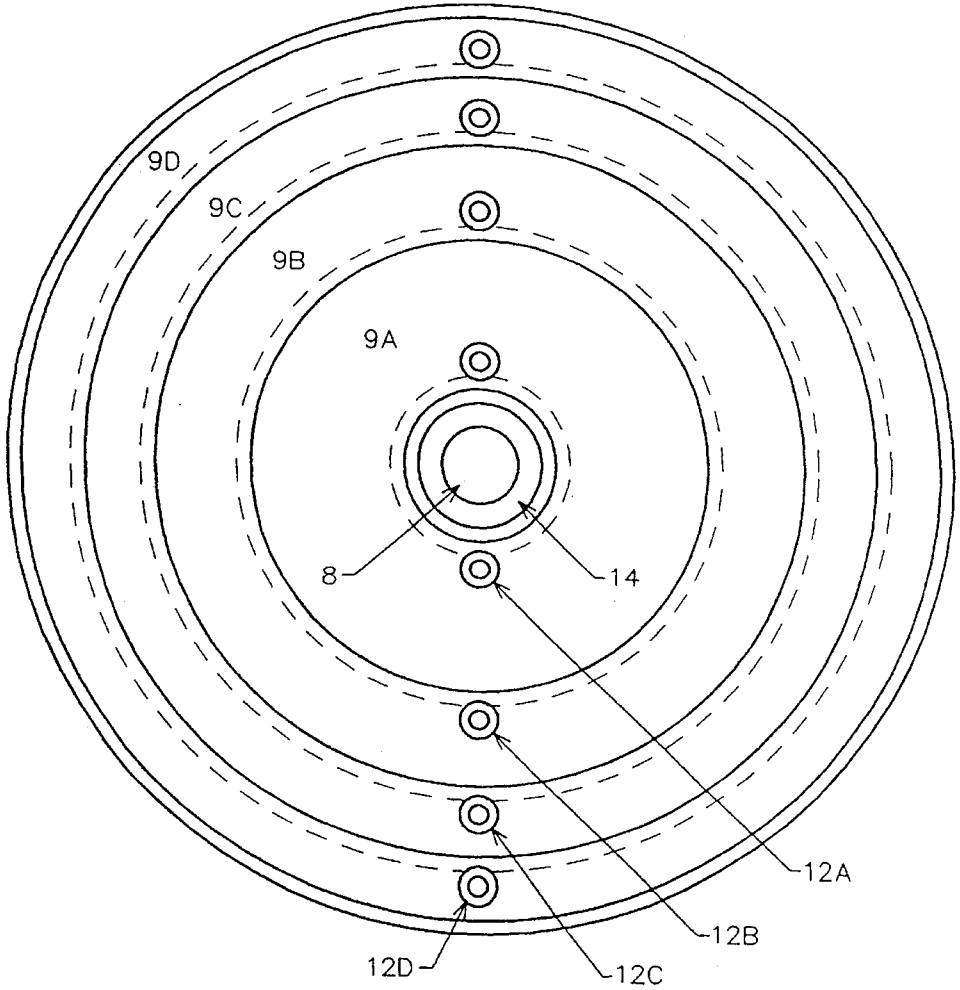
FIG. 4 shows the manner in which the rings fit together to form a complete disk.
Figure 4A:
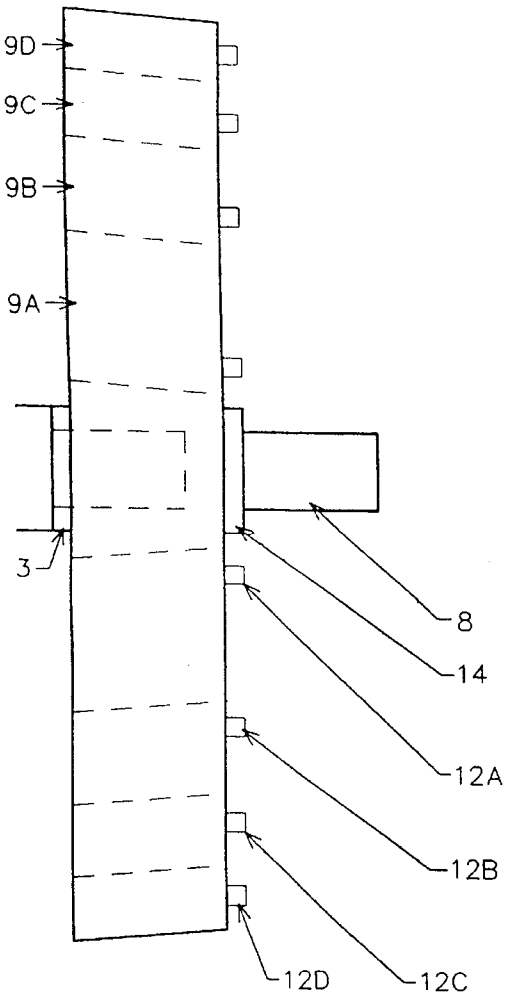

Referring to FIGS. 1, 2, and 3 an embodiment of the invention is shown in which the weight ring 9 is attached to the outside rotational surface 5 of the weight collar. The weight collar is screwed onto the threaded end 2 of weight bar 3.

In this embodiment the threaded center 7 of the non rotational section of the weight collar 3 is screwed tightly onto the threaded end 2 of the weight bar. The outside rotational surface 5 would be allowed to rotate freely as the weight bar is held in place. The rotatability of the outside section 5 would be accomplished by means of a circumfrential bearing surface 4 intermediate to the outside rotational surface 5 and the center non rotational section 3 of the collar. This would be held in place by locking nut 14. Weight ring 9 would slide over the outside rotational surface 5 of the weight collar and secure by means of a ball bearing 11 which would seat into groove 6 on the outer rotational surface 5 of the collar. An internal spring 113 and plunger 12 mounted internally on the inner circumfrence of weight ring 9 would allow the metal ball 11 to be seated or unseated from groove 6 by pressing the plunger with your thumbs.

Additional weight rings made to proportional size could be added circumjacent to the outside of the previous ring(s).

The end of the weight bar shown 15 is a separate bar screwed into the ends of the bar 1 and when unscrewed could be used as a dumbell. The threaded end 8 of the weight collar 5 could be used to attach additional collars.

I claim:

1. An exercise weight ring system comprising:

a collar;

means for attaching the collar to a weightlifting bar;

a plurality of progressively larger weight rings, the larger configured to circumscribe the smaller, the smallest configured to circumscribe the collar; and means for securing the larger weight ring(s) to the smaller and for securing the smallest weight ring to the collar.

2. The exercise weight ring system of claim 1 wherein the securing means comprises a groove on the outer surface of the smaller weight ring(s) and the collar, and a means on each weight ring for engaging the corresponding groove.

3. The exercise weight ring system of claim 2 wherein the engaging means comprises a bearing on the inner surface of the weight rings and a means on each weight ring for seating and unseating the bearing in the corresponding groove.

4. The exercise weight ring system of claim 3 wherein the seating/unseating means comprises a spring-loaded plunger.

5. The exercise weight ring system of claim 1 wherein the attaching means comprises the collar having a threaded section for connecting to a complementary threaded section of a weight bar.

6. The exercise weight ring system of claim 1 wherein the collar further comprises a means for connecting to another collar.

7. The exercise weight ring system of claim 6 wherein the means for connecting to another collar comprises a threaded section for connecting to a complementary section of another collar.

8. The exercise weight ring system of claim 1 wherein the collar further comprises bearing means allowing free rotation of the collar with respect to the attaching means.

9. An exercise weight ring system comprising:

a weightlifting bar;

a plurality of progressively larger weight rings, the larger configured to circumscribe the smaller, the smallest configured to circumscribe the weightlifting bar; and means for securing the larger weight ring(s) to the smaller and for securing the smallest weight ring to the weight-lifting bar.

10. An exercise weight ring system comprising:

a weightlifting bar;

a collar attached to the weightlifting bar;

a plurality of progressively larger weight rings, the larger configured to circumscribe the smaller, the smallest configured to circumscribe the collar; and means for securing the larger weight ring(s) to the smaller and for securing the smallest weight ring to the collar.

11. The exercise weight ring system of claim 10 wherein the securing means comprises a groove on the outer surface of the smaller weight ring(s) and the collar, and a means on each weight ring for engaging the corresponding groove.

12. The exercise weight ring system of claim 11 wherein the engaging means comprises a bearing on the inner surface of the weight rings and a means on each weight ring for seating and unseating the bearing in the corresponding groove.

13. The exercise weight ring system of claim 12 wherein the seating/unseating means comprises a spring-loaded plunger.

14. The exercise weight ring system of claim 10 wherein the collar further comprises bearing means allowing free rotation of the collar with respect to the weightlifting bar.

* * * * *